US005101735A

United States Patent [19]

Williams

[11] Patent Number: 5,101,735

[45] Date of Patent: Apr. 7, 1992

[54] CONSTANT TENSION APPARATUS AND METHOD WITH ECCENTRIC CAM TO REGULATE TENSION

[76] Inventor: Matti I. Williams, 7 Manton Terr., Boston, Mass. 02134

[21] Appl. No.: 573,832

[22] Filed: Aug. 27, 1990

[51] Int. Cl.[5] ..... E01B 25/18

[52] U.S. Cl. ..... 104/117; 254/364

[58] Field of Search ..... 104/117; 242/107; 254/277, 364, 392; 187/1 A; 267/69, 70, 73

[56] References Cited

U.S. PATENT DOCUMENTS

| | | | |
|---|---|---|---|
| 916,081 | 4/1909 | Williams et al. | 104/117 |
| 2,280,105 | 1/1940 | Sturgess | 74/501 |
| 3,517,780 | 5/1968 | Quenot | 188/83 |
| 3,728,972 | 4/1973 | Gofoith et al. | 104/117 |
| 3,873,044 | 3/1975 | Flower | 242/147 R |
| 3,885,789 | 5/1975 | Deluty et al. | 242/83 A |
| 4,008,880 | 2/1977 | Devis | 254/161 |
| 4,318,308 | 3/1982 | Monteillet | 74/501.5 R |
| 4,470,355 | 9/1984 | Kunczynski | 104/196 |
| 4,614,130 | 9/1986 | Heismann et al. | 74/501 R |
| 4,682,760 | 7/1987 | Baumgarten | 254/199 |
| 4,760,622 | 8/1988 | Rohrman | 254/364 X |

FOREIGN PATENT DOCUMENTS

| | | | |
|---|---|---|---|
| 315182 | 10/1919 | Fed. Rep. of Germany | 104/117 |

*Primary Examiner*—Robert J. Oberleitner
*Assistant Examiner*—S. Joseph Morano
*Attorney, Agent, or Firm*—Damon J. Borrelli

[57] ABSTRACT

Disclosed is a tensioning apparatus and method for creating and maintaining a substantially constant tension force in a flexible cable or shaft element. The apparatus used for maintaining the flexible cable at a constant tension includes interconnected reel and camming elements joined to a resiliently acting element. The reel and camming elements cooperate to adjust a variable tension force produced by the resiliently acting element to a substantially constant tension force of selected characteristic in the flexible cable.

18 Claims, 3 Drawing Sheets

CONSTANT TENSION APPARATUS AND METHOD WITH ECCENTRIC CAM TO REGULATE TENSION

BACKGROUND OF THE INVENTION

This invention relates generally to tension control systems. More particularly, the invention relates to apparatuses and methods for maintaining a constant tension in a flexible cable.

The need for an apparatus capable of creating and maintaining a constant tension is a flexible cable in acute in a wide variety of cable systems, e.g., electric trolley systems, exercise devices, and aerial tramways. In particular, these systems require apparatuses, and methods for the operation thereof, which are capable of maintaining a cable at a substantially constant tension during fluctuating climatic and loading conditions. Further, the cable tension must often be maintained within a selected, narrow range for efficient and safe operation.

Depending on the application for which it is used, flexible cabling can be formed of single or multiple strands. Further, the cabling can be spliced to form a continuous loop, as in the case of aerial tramways, or have both ends anchored, as for trolley systems. Several apparatuses have been developed to attain and maintain spliced or anchored cable at a substantially constant tension. These apparatuses include counterweighted, pneumatic, frictional, and spring-loaded assemblies. See, e.g., U.S. Pat. Nos. 3,885,789; 4,318,308; 4,470,355; 4,614,130; and 4,682,760. Although effective in many applications, these apparatuses often have severe design limitations such as massive and unwieldy weights, components which can jam or fail, e.g., pulleys and pivots, and generally slow reaction times to dynamic loadings. These limitations, as well as the economic inefficiency resulting from extended down-time for the repairs typically required to service these devices, renders them inappropriate for many uses.

It is accordingly an object of this invention to provide an apparatus and method for creating and maintaining a substantially constant force in a flexible cable.

It is another object of the invention to provide an apparatus and method that is economical to manufacture, easy to use, and that provides a reliable, substantially constant tension force in a flexible cable.

Other general and specific objects of the invention will in part be obvious and will in part appear hereinafter.

SUMMARY OF THE INVENTION

The invention attains the foregoing objectives with an apparatus that includes a reel element, a camming element, and a resiliently acting element. These elements cooperate to create and maintain a substantially constant tension force of selected characteristic in a flexible cable. The invention also provides a method for maintaining a substantially constant tension force in the cable.

More particularly, the reel element is configured to removably and replaceably wind a first flexible cable. The first cable can include a spooling portion, which winds on to and off of the reel element, and a working portion, typically in contact with the given dynamic load, connected by an joining element. In applications where the working portion of the first cable is to be electrified, it is preferred that the joining element be made of an insulative material to prevent charging of the entire tensioning apparatus. Typically, the reel element comprises a substantially circular spool to assure a smooth winding and release action.

The camming element is connected to the reel element and removably and replaceably winds a first end of a second cable. Preferably, the camming element is an arcuate cam surface integral with an external surface of the reel element.

The resiliently acting element receives a second end of the second flexible cable. This element produces a variable tension force characteristic which it communicates to the second cable. Preferably, the resiliently acting element includes a compression spring, more particularly a pair of juxtaposed compression springs. Generally, the tension force characteristic required in the first cable, and the relationship between the spool and reel elements, determines the force tension characteristic which the resiliently acting element must produce for efficient operation of the apparatus of the invention.

The second cable can be angled relative to the first cable. For example, the first and second cables can be at an angle of zero degrees to each other, i.e., parallel, for applications wherein the area containing the apparatus of the invention is limited. Alternatively, the first cable can be positioned substantially normal to the second cable, such as for overhead cabling suspended from periodic supports.

The invention also contemplates a method of maintaining a substantially constant tension in a first cable. The method includes first providing the above-described tensioning apparatus having a first spooling portion of the first cable removably and replaceably wound thereon. Next, a selected tension force is produced in the spooling portion of the first cable. Preferably, deflection of a compression spring produces the desired tension force. The spooling portion of the first cable is then connected to a working portion, for example, a trolley cable. Once the spooling and working portions are connected, typically by either splicing or an insulative joining element, the reel and camming elements are permitted to cooperate so as to adjust a variable tension force in the second cable, produced by a resiliently acting element, to a substantially constant tension force of selected characteristic in the first cable.

The method can also include mounting the tensioning apparatus such that the second cable is angled relative to the first cable. For example, the apparatus can be mounted such that the first and second cables are at an angle of zero degrees to each other, i.e., parallel. Alternatively, the apparatus can be mounted such that the first cable is substantially normal to the second cable.

The foregoing features of the invention, and others described below, provide a highly reliable apparatus and method for maintaining a substantially constant tension force in a flexible cable. The invention can be practiced economically and hence cost competitively with existing practices and structures.

Although the invention thus provides an apparatus for creating and maintaining a substantially constant force tension characteristic in a flexible cable, features of the apparatus and method can be used to advantage together with a wide variety of rigid or semi-rigid materials, and the invention has corresponding scope.

The invention will next be described in connection with certain illustrated embodiments. However, it should be clear to those skilled in the art that various modifications, additions and subtractions can be made without departing from the spirit or scope of the claims.

BRIEF DESCRIPTION OF THE DRAWINGS

For a fuller understanding of the nature and objects of the invention, reference should be made to the following detailed description and the accompanying drawings, in which.

DETAILED DESCRIPTION

Figure 1:
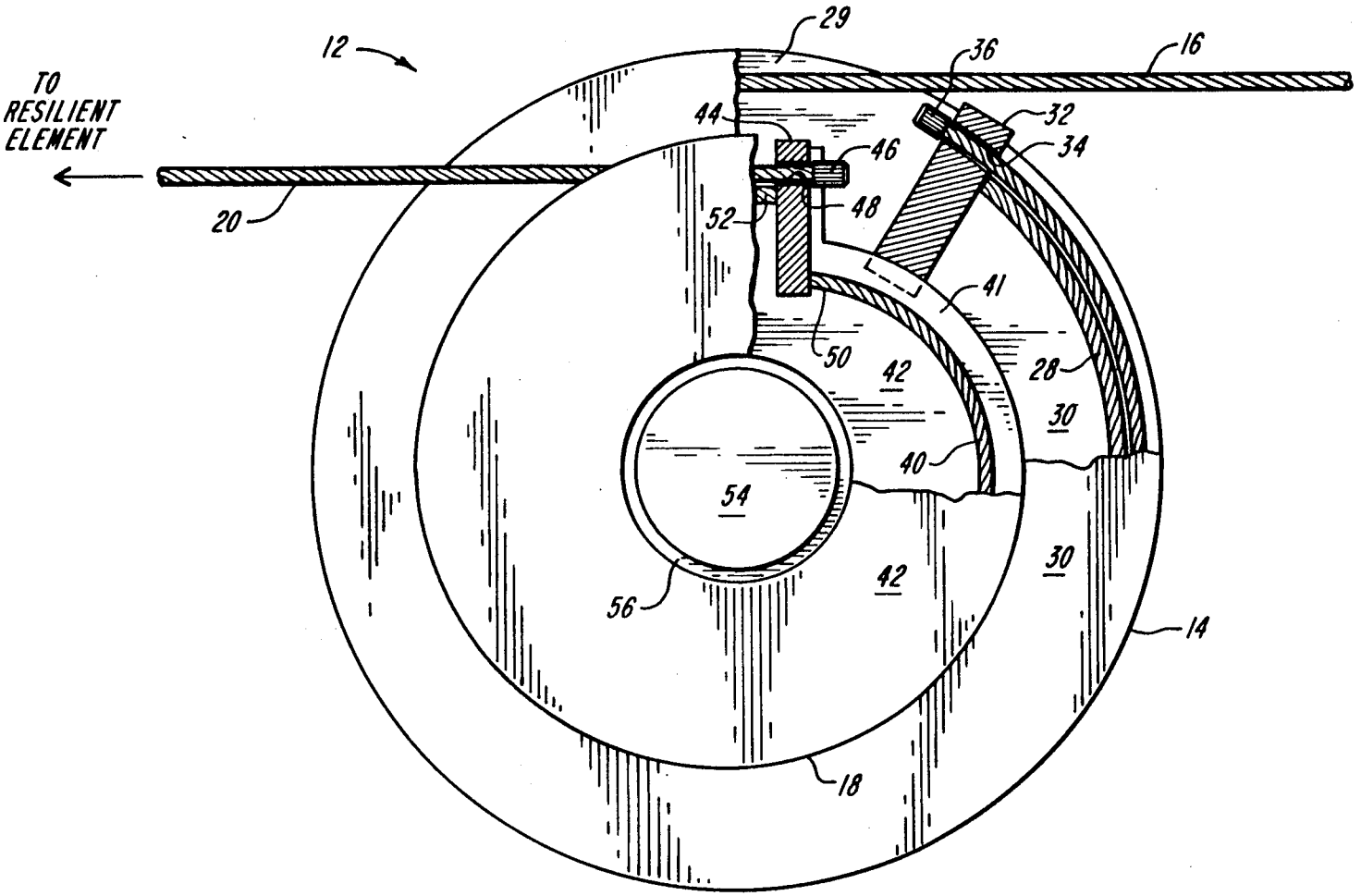
FIG. 1 is a top view, partially cut-away, of a camming element and a reel element according to the invention.

Referring to FIGS. 1 through 4, wherein like reference numerals refer to like parts, there is illustrated a tensioning apparatus 10. The tensioning apparatus 10 includes a cam unit assembly 12 including a reel element 14, which removably and replaceably receives a first cable 16, with a camming element 18 connected to its external surface. Removably and replaceably wound onto camming element 18 is a first end of a second cable 20. The second end of the second cable 20 is attached to a resiliently acting element 22.

FIG. 1 depicts the cam unit assembly 12. The assembly 12 includes a reel element 14 and a camming element 18. The reel element 14 is typically manufactured from a spool ring 28 placed between oppositely disposed spool plates 30. When constructed in this manner, the spool ring 28 is preferably welded to adjacent surfaces of each of the spool plates 30, however, any technique which efficiently joins these components can be used. Altenatively, the reel element 14 can be machined, using techniques familiar to those skilled in the art, from a unitary piece of appropriate material. The spool ring 28 and spool plates 30 cooperate to form a channel 29 which removably and replaceably receives the first cable 16 during winding and unwinding thereof. A spool anchor support 32, having an aperture 34 for receiving a first end of the first cable 16, extends through the spool ring 28 and is also welded to each of the spool plates 30. A first end of the first cable 16 has a flange 36 affixed thereto which prevents the cable 16 from slipping through aperture 34 and detaching from the cam unit assembly 12. The spool ring 28, spool plates 30, spool anchor support 32, and flange 36 can be constructed of virtually any strong, durable material, such as aluminum, stainless steel, or polymeric composites. The diameter of the spool ring 28 can be determined using the relationships described in detail below.

The first cable 16 can be a unitary piece of cabling. In embodiments of the invention wherein the first cable 16 is electrified, e.g., in overhead trolley systems such as that employed by the Massachusetts Bay Transportation Authority as part its the bus and light rail vehicle (L.R.V.) transit systems, it typically includes a spooling portion, which winds on and off the reel portion 14, and a working portion in contact with the dynamic load. These segments are preferably joined using an insulative connector (not shown) formed of ceramic, glass, or other suitable material familiar to those in the art.

The camming element 18 is typically formed from a arcuate cam ring 40 positioned between oppositely disposed cam plates 42. When constructed in this manner, the cam ring 40 is welded to adjacent surfaces of each of the cam plates 42, however any technique which efficiently joins these components can be used. Alternatively, the camming element 18 can be machined, using techniques familiar to those skilled in the art, from a unitary piece of suitable material. The cam ring 40 and cam plates 42 cooperate to form a channel 41 which removably and replaceably receives the second cable 20 as it is wound and unwound. A cam anchor support 44, having an aperture 48 for receiving a first end of the second cable 20, is connected to ends 50 and 52 of the cam ring 40 as well as welded to the adjacent surfaces of each of the cam plates 42. The first end of the second cable 20 has a flange 46 affixed thereto. Like the flange 36, flange 46 prevents the second cable 20 from slipping through the aperture 48 and detaching from the cam unit assembly 12. The components of the camming element 18 can be constructed of virtually any strong, durable material, such as aluminum, stainless steel, or polymeric composites. The arcuate shape of the cam ring 40 can be determined using the relations given below.

Preferably, the camming element 18 is intergral with an external surface of the reel element 14. The camming element 18 can be connected to the reel element 14 by rivets, welding, or the like. Preferably, the reel element 14 and the camming element 18 have a coaxial central aperture 54. The central aperture 54 is positioned along the axis of rotation of the reel and camming elements 14 and 18. A hub 56, the outer surface of the aperture 54, preferably extends from the external surface of the reel element 14 to the external surface of the camming element 18 and can provide a seat for at least one force-fitted bearing (not shown). A shaft (not shown), around which the camming element 18 and reel element 14 rotate, extends through the bearing located within the hub 56. Preferably, the hub 56 is manufactured from a double-extra strong seamless steel pipe.

Figure 3:
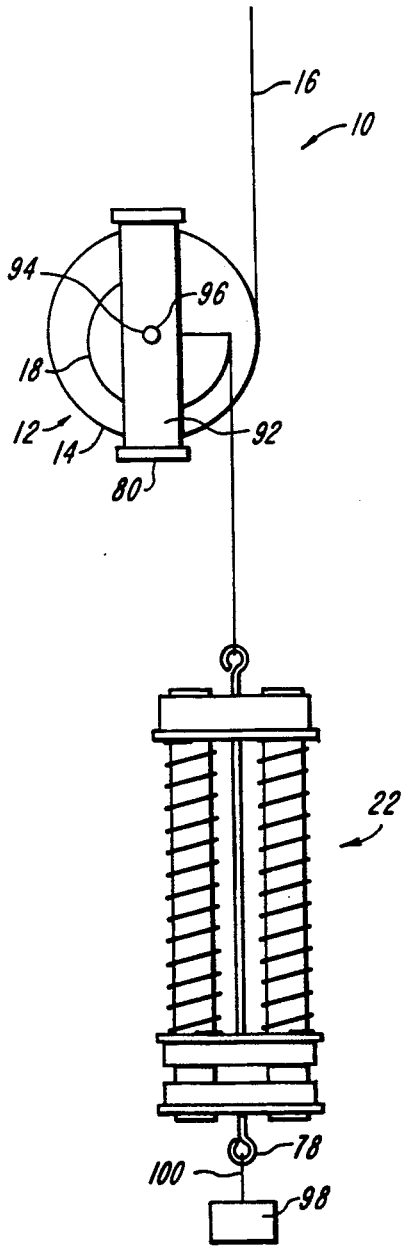
FIG. 3 is a top view illustrating a first embodiment of the invention.
Figure 4:
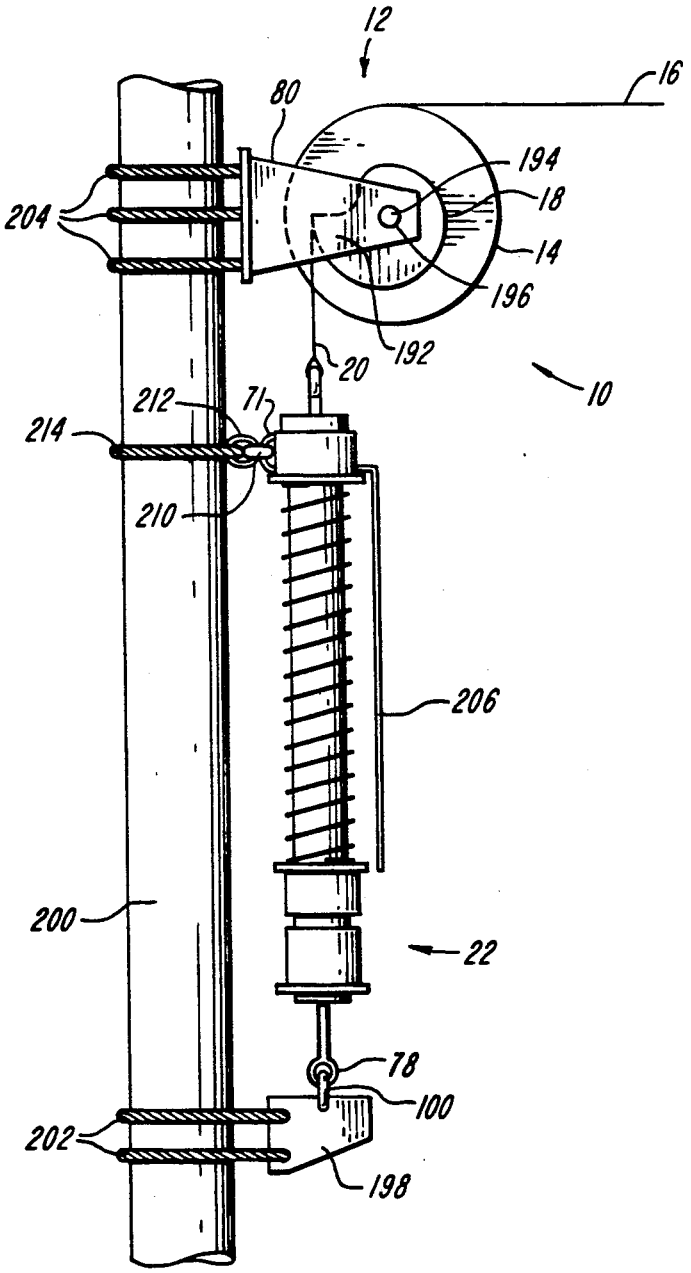
FIG. 4 is a side view illustrating a second embodiment of the invention.

As shown in FIGS. 3 and 4, and discussed in detail below, the cam unit assembly 12 is typically positioned for use in a mount 80. Preferably the mount 80 allows for unobstructed rotational movement of the cam unit assembly 12.

The entire cam unit assembly 12, and its associated mount 80, can be encased in a protective shroud (not shown) to protect the assembly 12 from the effects of weather, dust, and the like.

If desired, the reel element 14 of the cam unit assembly 12 can be replaced with shaft element. As a result of this substitution of parts, the apparatus 10 can provide a shaft having substantially constant torsional force. Preferably, the shaft is integral with an external surface of the cam element 18. The remainder of the structure, e.g., the resiliently acting element 22, and the interconnections therebetween, are as described herein.

Figure 2:
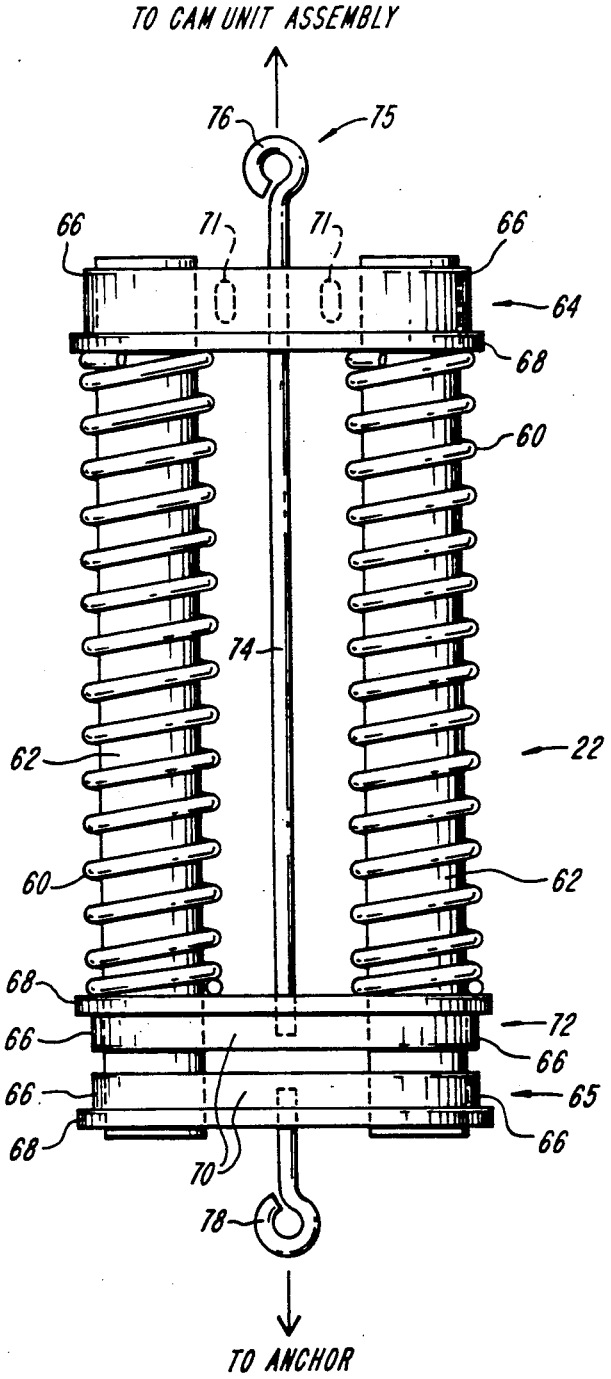
FIG. 2 is a side view of a resiliently acting element according to the invention.

FIG. 2 illustrates the resiliently acting element 22. Preferably, the resiliently acting element 22 includes a pair of juxtaposed compression springs 60. The springs 60 produce a force characteristic which varies depending upon the amount of deflection. Useful springs 60 include those manufactured and sold by Diamond Wire Spring Company, Pittsburgh, Pa. and Ohio Brass Co., Mansfield, Ohio. For example, useful springs 60 manufactured by Diamond Wire Spring Company have an inside diameter of 3.833 inches, an outside diameter of 5.207 inches, and producing a tension force characteristic of 2,615 pounds at a deflection of 58.82 inches. The characteristics of useful springs 60 manufactured by the Ohio Brass Co. are delineated below in Examples I and II. Of course, any other spring satisfying the design and operational requirements of a given application can also be used.

Each of the springs 60 encircle a spring guide shaft 62. The guide shafts 62 prevent bending of the springs 60 in a direction other than parallel to any compressive or expansive forces. Secured on the ends of guide shafts 62 are brackets 64 and 65 which, inter alia, properly align the guide shafts 62 relative to each other. The brackets 64 and 65 typically include a pair of tubes 66 each of which is sized to receive a guide shaft 62. The tubes 66 are secured to a flange 68 using techniques familiar to those skilled in the art, and are reinforced by supports 70. The bracket 64 also includes spring supports 71 (shown in phantom) which, as shown in greater detail in FIG. 4, help secure the resilient acting element 22 to a given support for both normal operation and in the event first cable 16 and/or second cable 20 fails.

The resiliently acting element 22 also preferably includes a third bracket 72, which can be movable along and over the guide shafts 62 in response to the deflection of the springs 60. The bracket 72 also includes tubes 66 mounted on a flange 68 and reinforced by supports 70. In the preferred embodiment of the invention, one end of each of the springs 60 bear against flange 68 of the bracket 64. The other end of each of the springs 60 bear against the flange 68 of the bracket 72.

As shown in FIG. 4, the resiliently acting element 22 can also include a movement indicator 206 having a series of indicia (not shown) thereon. During mounting of the apparatus 10, the movement indicator 206 can be used to help set the springs 60 to a selected deflection for a given ambient temperature. Once the apparatus 10 is properly positioned, and throughout operation, the indicator 206 permits users to quickly determine whether the apparatus 10 is responding properly to climatic and/or loading conditions by merely noting the position of the flange 68 of the bracket 72 relative to the given indicia. Although the indicia preferably indicate the position of the flange 68 of bracket 72 at various temperatures, it is recognized that the indicia can be spaced so as to indicate other relationships, e.g., the spring force characteristic of resiliently acting element 22 at various deflections of the springs 60. The spacing for the indicia can be determined empirically.

To connect the cam unit assembly 12 and resiliently acting element 22 a second end of the second cable 20 is secured to a connection assembly 75. In particular, the cable 20 is secured to an eye nut 76 of the connection assembly 75 using techniques familiar to those skilled in the art. The eye nut 76 can be threadably secured to a shaft 74. Alternatively, the eye nut 76 and shaft 74 can be a unitary component. The shaft 74 preferably extends through an aperture (not shown) in the bracket 64 and connects to the flange 68 of third bracket 72. The flange 68 of bracket 65 has an eye bolt 78 attached thereto. The eye bolt 78 can be anchored directly or indirectly, i.e., via a cabling or a shackle, to a support. Once the cable 20 is secured to the eye nut 76, and the eye bolt 78 anchored to a support, a variable force tension characteristic can be produced in the second cable 20 by deflecting the springs 60.

Preferably the resiliently acting element 22 is encased in a protective shroud (not shown) to protect this portion of the apparatus 10 from the effects of weather, dust, and the like. It is especially preferred that the shroud have sufficient structural integrity to contain components of the element 22 in the event the springs 60 or any other components experience structural failure.

The reel element 14 and the camming element 18 cooperate to adjust the variable force tension characteristic produced by the resiliently acting element 22, and communicated to the second cable 20, to a substantially constant force tension characteristic in the first cable 16. This result is achieved by selecting a moment arm for the cam ring 40 and a diameter for the spool ring 28 in accordance with the formulas given below. The moment arm of the cam ring 40 decreases in proportion to an increase in the force characteristic of the resiliently acting element 22.

To design the cam unit assembly 12, the minimum and maximum radius of the cam ring 40 is first calculated using the sequence of equations set forth below. The equations are based upon the relationship between the components at static equilibrium. The following abbreviations are used in these formulas:

Min. = Minimum

Char. = Characteristic

Pref. = Preferred

Equations (Eq.) 1 and 2 express the static equilibrium of the cam unit assembly 12 at minimum and maximum spring force.

Minimum Spring Force Char., Static Equilibrium Formula:

$$((\text{Min. Force Char.}_{Spring})(\text{Cam Ring Radius}_{Maximum})) = (\text{Pref. Constant Force Char.})(\text{Spool Ring Radius}) \quad \text{[Eq. 1]}$$

Maximum Spring Force Char., Static Equilibrium Formula:

$$((\text{Max. Force Char.}_{Spring})(\text{Cam Ring Radius}_{Minimum})) = (\text{Pref. Constant Force Char.})(\text{Spool Ring Radius}) \quad \text{[Eq. 2]}$$

Since preferred constant force characteristic and the spool ring radius are the same in both equations, it is possible to set Equation 1 equal to Equation 2 and obtain Equation 3 below.

$$((\text{Min. Force Char.}_{Spring})(\text{Cam Ring Radius}_{Maximum})) = ((\text{Max. Force Char.}_{Spring})(\text{Cam Ring Radius}_{Minimum})) \quad \text{[Eq. 3]}$$

Based on Equation 3, the maximum radius (Cam Ring $\text{Radius}_{Maxmimum}$) of the cam ring 40 is defined by the following formulas:

$$\frac{((\text{Max. Force Char.}_{Spring})(\text{Cam Ring Radius}_{Minimum}))}{(\text{Min. Force Char.}_{Spring})} \quad \text{[Eq. 4]}$$

or $$\frac{(\text{Pref. Constant Force Char.})(\text{Spool Ring Radius})}{(\text{Min. Force Char.}_{Spring})} \quad \text{[Eq. 5]}$$

Next, the mean circumference ($r_{Mean}$) of the cam ring 40 is estimated using the formula:

$$\text{Circumference}_{Camming\ Ring} = 2(\pi) r_{Mean} \quad \text{[Eq. 6]}$$

However, mechanical interference, due to the presence of the cam anchor support 44 and the design of the camming element 18 itself, limit rotation of the camming element 18 to 270 degrees or three-quarters of a revolution. Thus, a more accurate formula for the mean circumference of the cam ring 40 is:

$$\text{Circumference}_{Cam\ Ring} = 2(\tfrac{3}{4})(\pi)r_{Mean}$$

or $$\text{Circumference}_{Cam\ Ring} = 3/2(\pi)r_{Mean} \quad \text{[Eq. 7]}$$

Next, the change in the length of the springs 60 of the resiliently acting element 22 between maximum and minimum deflection is empirically determined. Since the cam ring 40 must have a sufficient mean radius to accept as much of cable 20 as may be wound or unwound during deflection of the springs 60, this length is then substituted into Equation 7 for the $\text{Circumference}_{Cam\ Ring}$. This substitution produces Equation 8. Equation 8 can then be solved, using the formulas presented in Equations 9 and 10, the ratio of Cam Ring $\text{Radius}_{Minimum}$ to Cam Ring $\text{Radius}_{Maximum}$ obtained from Equation 4, and mathematical problem solving techniques familiar too those skilled in the art, to provide the maximum and minimum radius for the cam ring 40.

$$\text{Change in Length of Springs} = 3/2(\pi)r_{Mean} \quad \text{[Eq. 8]}$$

or $$r_{Mean} = \frac{\text{Change in Length of Springs}}{3/2(\pi)} = \quad \text{[Eq. 9]}$$

$$\frac{\text{Cam Ring Radius}_{Minimum} + \text{Cam Ring Radius}_{Maximum}}{2} \quad \text{[Eq. 10]}$$

Using the maximum cam ring radius determined using Equation 9 and 10, and the relation between the maximum cam ring radius and spool ring radius defined by Equation 5 above, the radius of the spool ring 28 can be calculated using techniques familiar to those skilled in the art. Further, once the radius of the spool ring 28 is known its working circumference, i.e., that portion of the circumference capable of removably and replaceably winding the first cable 16, can be determined using a formula similar to Equation 7. Mechanical interference, in this case due to the position of the spool anchor support 32, also limits rotation of the reel element 24 to 270 degrees or three-quarters of a revolution. Accordingly, the formula for the working circumference of the spool ring 28 is:

$$\text{Circumference}_{Spool\ Ring} = 3/2(\pi)\text{Spool Ring Radius} \quad \text{[Eq. 11]}$$

Having determined the working circumference of the spool ring 28, the length of cable 16 which can be held at a constant tension over a selected temperature range can be determined using Equation 12 below and mathematical problem solving techniques familiar to those skilled in the art.

$$\delta = \alpha L(\Delta T) \quad \text{[Eq. 12]}$$

where:

$\delta$ = Change in Length of the Cable 16 Over Selected Temperature Range [Working circumference of the Spool Ring 28]

$\alpha$ = Coefficient of Thermal Expansion of the Cable 16

L = Length of Cable 16 Which Can Be Held at Constant Tension $\Delta T$ = Selected Temperature Range Thus, by using the above algebraic relations, the preferred maximum and minimum radius of the cam ring 40, and radius of the spool ring 28, can be determined. Those skilled in the art will appreciated that similar equations can be used to determine the intervening radii of the cam ring 40.

FIG. 3 depicts a tensioning apparatus 10 in accordance with invention. The apparatus 10 is constructed such that the first cable 16 extends substantially parallel to the second cable 20. The cam unit assembly 12 and the resiliently acting element 22 used in this embodiment of the invention are as described above in connection with FIGS. 1 and 2. The resiliently acting element 22 is anchored in position, to, for example, a cement structure, by an attachment element 98; the attachment element 98 is connected to the eye bolt 78 using a shackle 100. The upper portion of the element 22 is secured to a support using a cable (not shown), or similar material, which passes through the spring supports (not shown) and a connector (not shown) on the support surface. Preferably, the connector and attachment element 98, as well as their associated components, permit the element 22 to pivot on the attachment element 98 up to about one foot in any given direction. By allowing the element 22 to pivot, cable 20 remains substantially normal to a radii of cam ring 40 at the point where the cable 20 winds onto or off of the cam ring 40. As shown in the FIGURE, the mount 80 can be constructed so that the reel element 14 and camming element 18 rotates in a plane which is parallel to a plane containing the springs 60 of the resiliently acting element 22. In particular, the mount includes a pair of oppositely disposed plates 92 which have a coaxial aperture 94 and are sufficient separated to receive the cam unit assembly 12. The aperture 94 receives a shaft 96 extending through the hub 56 of the cam unit assembly 12. Generally, the shaft 96 is secured in the amount 80 such that it is substantially normal to the plane containing the springs 60.

FIG. 4 depicts another embodiment of the invention wherein the first cable 16 extends substantially normal to the second cable 20. This embodiment of the invention is especially useful in conjunction with overhead trolley systems, e.g., that employed by the Massachusetts Bay Transportation Authority as part of its bus and Light Rail Vehicle (L.R.V.) transit systems. The cam unit assembly 12 and the resiliently acting element 22 used in this embodiment of the invention are as described above in connection with FIGS. 1 and 2. An attachment element 198, which is secured to a columnar support 200 using bands 202, provides an anchor point for the resiliently acting element 22. The attachment element 198 is connected to the eye bolt 78 using a shackle 100. The upper position of the element 22 is secured using a cable 210, or similar component, which passes through the spring supports 71 and a chain link 212 connected to a pole clamp 214. Preferably, the cable 210 and the attachment element 198, as well as their associated components permit the elements 22 to pivot on attachment 198 up to about one foot in any given direction. By allowing the element 22 to pivot, cable 20 remains substantially normal to a radii of the cam ring 40 at the point where the cable 20 winds onto or off of the cam ring 40. As shown in the FIGURE, in this embodiment of the invention, the mount 80 is constructed so that the reel element 14 and camming element 18 rotate in a plane which is substantially normal to a plane containing the springs 60 of the resiliently acting element 22. The mount 80 can be secured to the columnar support 200 using a series of bands 204. A pair of oppositely disposed plates 192, having a coaxial aperture 194 and being sufficiently separated to receive the cam unit assembly 12, form the mount 80. The aperture 194 receives a shaft 196 extending through the hub 56 (see FIG. 1) of the cam unit assembly 12. Generally, the shaft 196 is secured by the mount 80 in a position substantially parallel to the plane containing the springs 60.

Although the FIGURES, and foregoing description, delineate embodiments of the invention wherein the second cable 20 is either substantially parallel or substantially normal to the first cable 16, it will be recognized by those skilled in the art that the apparatus 20 can be configured such that the first and second cables 16 and 20 are at virtually any angle relative to each other. In addition, those skilled in the art will appreciate that reel element 14 and camming element 18 and springs 60 of the resiliently acting element 22 can also be positioned such that the planes containing them are at virtually any angle relative to each other.

In operation the reel element 14 and the camming element 18 cooperate to adjust a variable tension force in the second cable 20, which is produced by the springs 60, to a substantially constant tension force of selected characteristic in the first cable 16. To commence operation, an apparatus 10 is constructed in conformance with the foregoing description. In particular, the cam unit assembly 12 and resiliently acting element 22 are constructed and linked together with the second cable 20. Further, a spooling portion of the first cable 16 is removeably and replaceably wound onto the reel element 14. The apparatus 10 is then mounted on a support surface such that the cam unit assembly 12 is selectably positioned relative to the resiliently acting element 22, e.g., as shown in FIGS. 3 or 4. Selection of an appropriate angle between the cam unit assembly 12 and resiliently acting element 22 permits controlling the eventual angle between the first cable 16 and second cable 20. Next, using a winch, or other apparatus familiar to those skilled in the art, the spooling portion of the first cable 16 and a working portion of the first cable 16, for example, a trolley cable, are pulled toward each other until the springs 60 reach the proper deflection as shown by movement indicator 206. In the final step, the spooling and working portions the first cable 16 are spliced together and the reel element 14 and camming element 18 are allowed to rotate as necessary to maintain a constant tension in the first cable 16.

The invention will be more apparent from the following illustrative, non-limiting examples.

EXAMPLE I

A single-spring tensioning apparatus was constructed for maintaining a trolley wire cable of 860 feet at a constant tension of 3000 pounds over a temperature range of 162 degrees Fahrenheit, more particularly, from −4 to 158 Fahrenheit.

In accordance with the invention, a camming element and a reel element were constructed from 1020 CR Steel. The camming element included a cam ring having a maximum radius of 5.369 inches and a minimum radius of 3.968 inches and a circumference of 22 inches. The spool ring of the reel element had a radius of 3.353 inches and a working circumference of 15.801 inces. The camming element and reel element were then aligned along a common axis and bolted together.

Next, the resiliently acting element was constructed using a single spring manufactured by the Ohio Brass. Co. of Mansfield, Ohio. The spring produced a force characterized of from 1870 pounds to 2530 pounds over a deflection of 22.09 inches.

Once the camming and resiliently acting elements were mounted and connected by a flexible 0.25 inch diameter aircraft cable, a cable formed of ¼ inch aircraft cabling was connected to the spool anchor support of the reel element. This cable, and a standard bronze ⅜ inch diameter trolley cable mounted for use in connection with a light rail vehicle system, were then pulled toward each other until the indicator on the resiliently acting element indicated the proper deflection for the ambient temperature at the time of assembly. The cabling connected to the reel element was then connected to the trolley cable with an insulative joint. The cam reel elements were then permitted to equilibrate in response to climatic and loading conditions.

The apparatus maintained at a constant force tension characteristic of 3000 pounds in the trolley wire.

EXAMPLE II

A double-spring tensioning apparatus was constructed for maintaining a trolley wire cable of about 1730 feet at a constant tension of 3000 pounds over a temperature range of 162 degrees Fahrenheit, more particularly, from −4 to 158 degrees Fahrenheit.

In accordance with the invention, a camming element and a reel element were constructed from 1020 CR Steel. The cam ring of the camming element had a maximum radius of 5.369 inches and a minimum radius of 3.968 inches with a circumference of 22 inches. The reel element had a radius of 6.706 inches and a working circumference of 31.60 inches. Once constructed, the camming element and reel elements were aligned along a common axis and bolted together.

Next, a resiliently acting element similar to that described in Example I was constructed. In this case, however, the resiliently acting element included two springs each manufactured by the Ohio Brass Co. of Mansfield, Ohio and having working load force of from 1870 pounds to 2530 pounds over a displacement of 22 inches.

Once the camming and resiliently acting elements were mounted and connected by a flexible 0.25 inch diameter aircraft cable, a cable formed of ¼ inch aircraft cabling was connected to the spool anchor support of the reel element. This cable, and a standard bronze ⅜ inch diameter trolley cable mounted for use in connection with a light rail vehicle system, were then winched toward each other until the indicator on the resiliently acting element indicated the proper deflection for the ambient temperature at the time of assembly. The cabling connected to the reel element was then connected to the trolley cable with an insulative joint. The cam and reel elements were then permitted to equilibrate in response to climatic and loading conditions.

The apparatus maintained a constant force tension characteristic of 3000 pounds in the trolley wire.

It will thus be seen that the invention efficiently attains the objects set forth above, among those made apparent from the preceding description. In particular, the invention provides a safe and efficient apparatus and method for creating and maintaining a substantially constant force tension characteristic in a flexible cable.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. An apparatus for maintaining a suspended cable at a constant tension, said apparatus comprising:

A.) a reel means for removably and replaceably winding a first flexible cable, said reel means having a first groove means for receiving said first cable, said first groove means being oriented in a first plane and having a width equal to about the diameter of said first flexible cable, said first cable being removably and replaceably wound within said first plane;

B.) a camming means for removably and replaceably winding a first end of a second flexible cable, said camming means being connected to said reel means and having a second groove means which is oriented in a second plane, said second plane being substantially parallel to said first plane, said second groove means having an eccentric profile and a width equal to about the diameter of said second flexible cable, said second cable being removably and replaceably wound within said second plane;

C.) a bias means for producing a variable tension force characteristic in said second cable, said bias means being compressed to produce said variable tension force characteristic in said second cable and receiving a second end of said second flexible cable;

whereby said reel means and said camming means cooperate to continuously adjust the variable tension force in said second cable to a substantially constant tension force of selected characteristic in said first cable.

2. The apparatus of claim 1 wherein said first cable comprises a spooling portion and a working portion.

3. The apparatus of claim 2 wherein said first cable further comprises an insulative joining means for connecting said spooling portion and said working portion.

4. The apparatus of claim 1 wherein said reel means comprises a substantially circular spool.

5. The apparatus of claim 1 wherein said camming means comprises an arcuate cam surface integral with an external surface of said reel means.

6. The apparatus of claim 1 wherein said bias means comprises a compression spring.

7. The apparatus of claim 6 wherein said bias means comprises a pair of juxtaposed compression springs.

8. The apparatus of claim 1 wherein said first cable is at an angle relative to said second cable.

9. The apparatus of claim 8 wherein said first cable and said second cable are substantially parallel.

10. The apparatus of claim 8 wherein said first cable and said second cable are substantially perpendicular.

11. A method of maintaining a substantially constant tension in a first cable, said first cable having a spooling portion and a working portion, comprising the steps of:

A.) providing an apparatus comprising:

1.) a substantially flat reel means having said spooling portion of said first cable removably and replaceably wound thereon, said reel means having a first groove means for receiving said spooling portion of said first cable, said first groove means being oriented in a first plane and having a width equal to about the diameter of said spooling portion of said first cable, said spooling portion of first cable being removably and replaceably wound within said first plane;

2.) a substantially flat camming means having a first end of a second flexible cable removably and replaceably wound thereon, said camming means being connected to said reel means and having a second groove means which is oriented in a second plane, said second plane being substantially parallel to said first plane, said second groove means having an eccentric profile and a width equal to about the diameter of said second flexible cable, said second cable being removably and replaceably wound within said second plane;

3.) a bias means for producing a variable tension force characteristic in said second cable, said bias means being compressed to produce said variable tension force characteristic in said second cable and receiving a second end of said second flexible cable;

B.) providing a tension force characteristic in said spooling portion of said first cable;

C.) connecting said spooling portion of said first cable to said working portion of said first cable;

D.) permitting said reel means and said camming means to cooperate so as to adjust the variable tension force in said second cable to a substantially constant tension force of selected characteristic in said first cable.

12. The method of claim 11 wherein said first cable further comprises an insulative joining means for connecting said spooling portion and said working portion.

13. The method of claim 11 wherein said reel means comprises a substantially circular spool.

14. The method of claim 11 wherein said bias means comprises a compression spring.

15. The method of claim 14 wherein said bias means comprises a pair of juxtaposed compression springs.

16. The method of claim 11 further comprising mounting said apparatus such that said first cable is at an angle relative to a said second cable.

17. The method of claim 16 wherein said first cable and said second cable are substantially parallel.

18. The method of claim 16 wherein said first cable and said second cable are substantially perpendicular.

* * * * *